US005566957A

United States Patent [19]

Ho

[11] Patent Number: 5,566,957

[45] Date of Patent: Oct. 22, 1996

[54] IN-LINE ROLLER SKATE HAVING ADJUSTABLE BIASING ANGLE FOR EACH INDIVIDUAL WHEEL

[75] Inventor: Diana Ho, Taichung, Taiwan

[73] Assignee: Monotype Supply Co., Ltd., Taichung, Taiwan

[21] Appl. No.: 503,741

[22] Filed: Jul. 18, 1995

[51] Int. Cl.[6] ..... A63C 17/04

[52] U.S. Cl. ..... 280/11.22; 280/11.27

[58] Field of Search ..... 280/11.19, 11.22, 280/11.23, 11.25, 11.26, 11.27; 301/1, 5.3

[56] References Cited

U.S. PATENT DOCUMENTS

| | | | |
|---|---|---|---|
| 1,975,661 | 10/1934 | Powell | 280/11.25 |
| 4,382,605 | 5/1983 | Hegna | 280/11.22 |
| 5,192,088 | 3/1993 | Yu | 280/11.19 |
| 5,303,940 | 4/1994 | Brandner | 280/11.22 |
| 5,312,120 | 3/1994 | Wiegner | 280/11.23 |

FOREIGN PATENT DOCUMENTS

| | | | |
|---|---|---|---|
| 0608576A1 | 8/1994 | European Pat. Off. | 280/11.22 |

*Primary Examiner*—Brian L. Johnson
*Assistant Examiner*—Min Yu

[57] ABSTRACT

An in-line roller skate includes: a mounting plate having a footwear or boot secured on an upper surface of the mounting plate, and having a plurality of arcuate guiding rails respectively juxtapositionally transversely formed on a bottom of the mounting plate, with a longitudinal axis defining at a center of the mounting plate and projectively developing a vertical plane from the longitudinal axis towards a skating surface under the mounting plate; a plurality of cantilever members each slidably engageable with and movably adjustable on each arcuate guiding rail on the mounting plate; and a plurality of wheels each rotatably mounted on each cantilever member, whereby upon an angular adjustment of each cantilever member on each guiding rail, each wheel as rotatably mounted on each cantilever member will be angularly biased from the vertical plane for obtaining a preferred angle for the skater for ergonomically enhancing a skating maneuverability.

5 Claims, 5 Drawing Sheets

IN-LINE ROLLER SKATE HAVING ADJUSTABLE BIASING ANGLE FOR EACH INDIVIDUAL WHEEL

BACKGROUND OF THE INVENTION:

Ernest E. Brandner discloses a skate having angularly mounted wheels in his U.S. Pat. No. 5,303,940, in which each of the plural wheels is arranged generally in an in-line relationship and disposed at an angle between 11° and 21° to the vertical, with at least two of said angularly disposed wheels being inclined in the same direction with regard to a vertical plane passed along the longitudinal axis of said mounting plate, and an intermediate, angularly mounted wheel located an equal distance between said at least two angularly disposed wheels and inclined in an opposite direction with respect to said at least two angularly disposed wheels, the non-perpendicular relationship of said wheels to the mounting plate enabling a user of the skate to achieve improved traction during a turn.

However, the wheels on the skate of Brandner are disposed with fixed angles, not being adjustable. Whenever it is intended to be used for a figure skating with diversified skating patterns, such a skate having wheels of fixed angles will influence the maneuverability for the skater since each skater has his (her) own preferred biasing angle for each individual wheel on the skate during the practice and training.

SUMMARY OF THE INVENTION:

The object of the present invention is to provide an in-line roller skate including: a mounting plate having a footwear or boot secured on an upper surface of the mounting plate, and having a plurality of arcuate guiding rails respectively juxtapositionally transversely formed on a bottom of the mounting plate, with a longitudinal axis defining at a center of the mounting plate and projectively developing a vertical plane from the longitudinal axis towards a skating surface under the mounting plate; a plurality of cantilever members each slidably engageable with and movably adjustable on each arcuate guiding rail on the mounting plate; and a plurality of wheels each rotatably mounted on each cantilever member, whereby upon an angular adjustment of each cantilever member on each guiding rail, each wheel as rotatably mounted on each cantilever member will be angularly biased from the vertical plane for obtaining a preferred angle for the skater for ergonomically enhancing a skating maneuverability.

Figure 6:
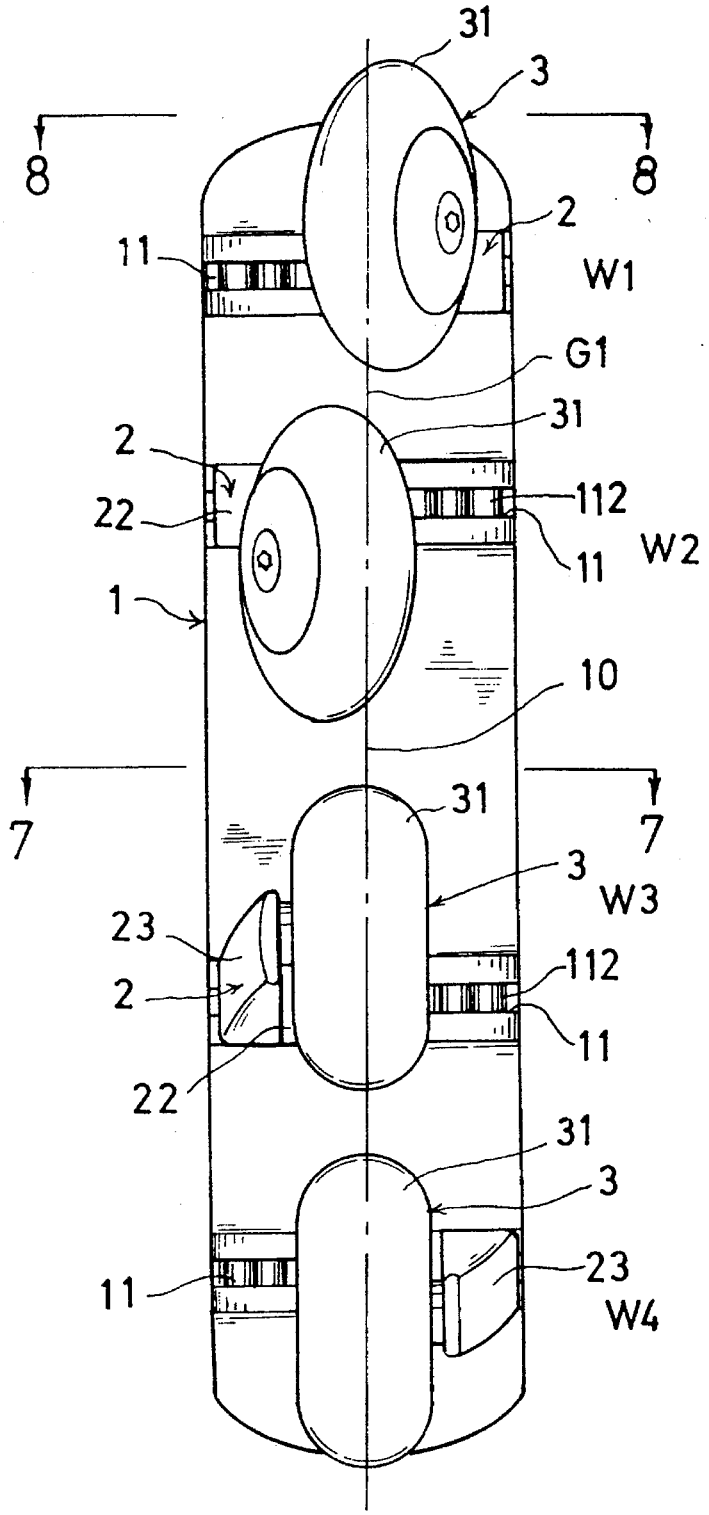
FIG. 6 is a bottom view of the present invention.

FIG. is a side view of the present invention when viewed from 8—8 direction of FIG. 6.

DETAILED DESCRIPTION:

As shown in the drawing figures, the present invention comprises: a mounting plate 1, a plurality of cantilever members 2, and a plurality of wheels 3 generally disposed under the mounting plate at an in-line relationship.

The number of wheels 3 are not limited in this invention. Each cantilever member 2 may be adjustably secured to the mounting plate 1 from either a right side portion or a left side portion of the mounting plate 1, depending on the assembly convenience and skating stability when manipulating the roller skate.

The mounting plate 1 having a footwear or boot 12 mounted on an upper surface of the plate 1 includes: a plurality of arcuate guiding rails 11 respectively juxtapositionally transversely formed on a bottom of the mounting plate 1, and a longitudinal axis 10 defining at a longitudinal center of the guiding rails 11 and the plate 1.

Each cantilever member 2 includes: an arcuate bracket 22, an arcuate groove 21 recessed in the arcuate bracket 22 and slidably engageable with each arcuate guiding rail 11 formed on the mounting plate 1, and a cantilever portion 23 protruding downwardly from the arcuate bracket 22 for rotatably mounting each wheel 3 on a lower portion of the cantilever portion 23.

The arcuate bracket 22 is formed with a plurality of bolt holes 221 equally spaced and arcuately formed on the bracket 22 along an upper curvature C of a tread center 32 of each wheel 3, and each arcuate guiding rail 11 formed with a plurality of bolt holes 111 equally spaced and arcuately formed on the arcuate guiding rail 11 along the upper curvature C, whereby upon locking of a locking bolt 20 through each bolt hole 221 formed in the bracket 22 and each bolt hole 111 formed in the rail 11, the bracket 22 of the cantilever member 2 may be stably locked on the guiding rail 11 at an acute biasing angle A of a wheel 3 from a vertical plane V vertically intersecting the longitudinal axis 10 of the mounting plate 1.

The plurality of bolt holes may be substituted with an arcuate slot (not shown) cut in the bracket or in the guiding rail for a slidable movement of the locking bolt and then locked in the arcuate slot for adjusting the biasing angle of the cantilever member 2 and the wheel 3 rotatably mounted on the cantilever member 2.

The arcuate groove 21 of the bracket 22 is formed with a corrugated bottom 211 in the arcuate groove 21 to movably engage a corrugated bottom portion 112 formed on a bottom of the guiding rail 11 for a stable engagement between the bracket 22 of the centilever member 2 and the guiding rail 11 of the mounting plate 1.

Figure 3:
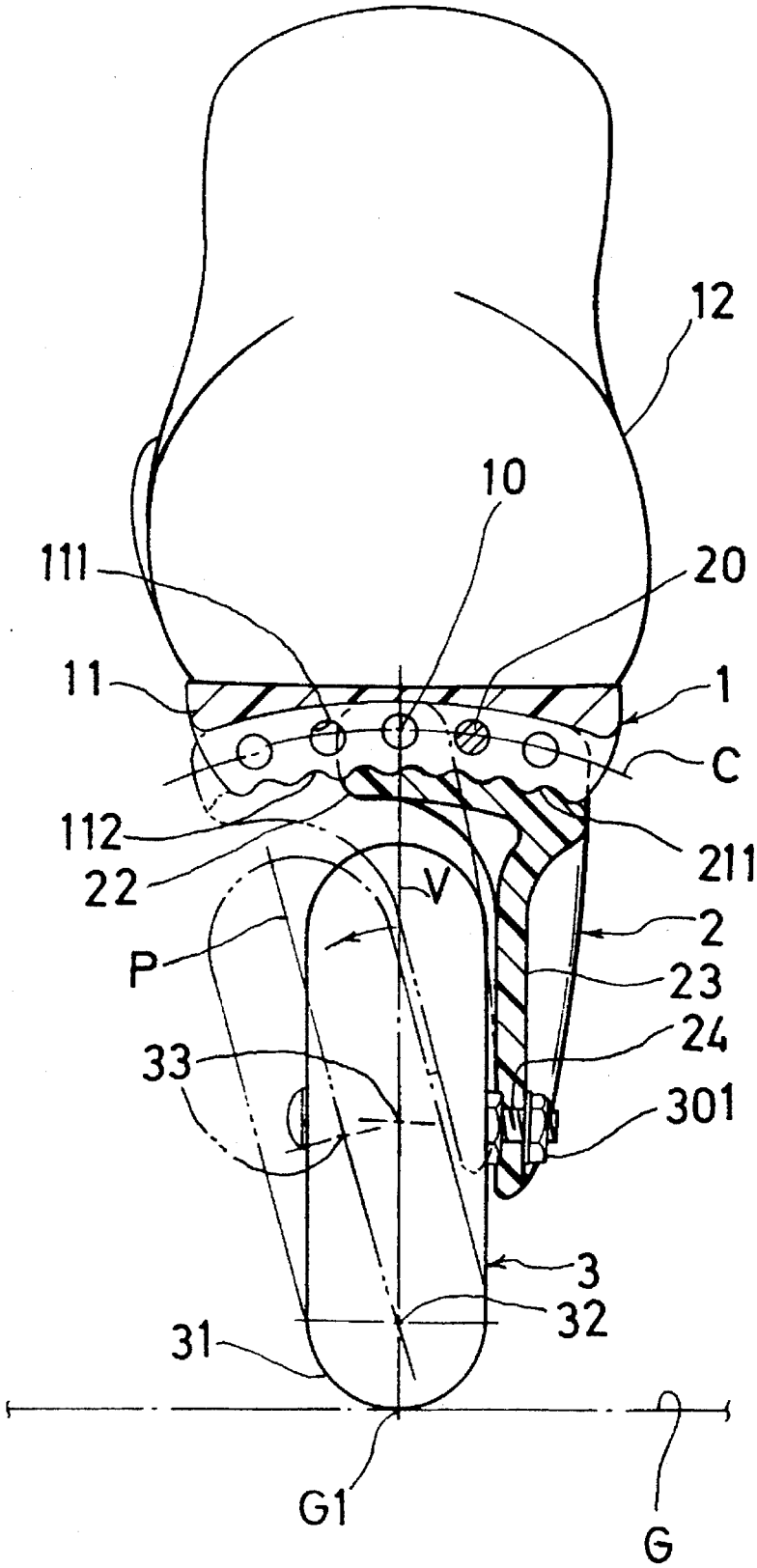
FIG. 3 is a partial longitudinal sectional drawing of the present invention.
Figure 4:
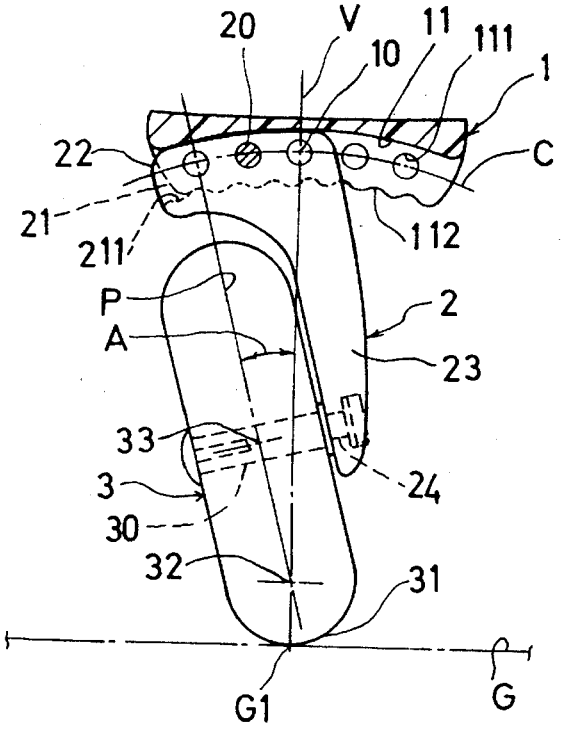
FIG. 4 shows a leftward biasing of the wheel of the present invention.

Each wheel 3 includes: an axle 30 which may be a bolt secured on an axle hole 24 formed in a lower end portion of the cantilever member 2 by a nut or pin (not limited) 301, a wheel center 33 formed at a center of the wheel 3, a tread center 32 formed at a curvature center of the circular tread 31 of the wheel 3 tangentially rolling on a skating surface G, a longitudinal circular plane P intersecting the wheel center 33 and being perpendicular to the axle 30, and the upper curvature C disposed about the tread center 32 having a radius spacing between each center of the bolt hole 111 formed in the guiding rail 11 and the tread center 32, whereby upon an in-line arrangement of a plurality of wheels 3 along the vertical plane V which will intersect the longitudinal axis 10 of the mounting plate 1, the wheel centers 33 and the tread centers 32 of the wheels 3, the longitudinal circular plane P of each wheel 3 will be coplanar to the vertical plane V and the wheels 3 will roll on the skating surface G along a straight line G1 as shown in FIG. 3 for a linear skating; and upon a tilting of the longitudinal circular plane P of each wheel 3 from the vertical plane V, a biasing angle A of each wheel 3 will be adjusted by slidably engaging the cantilever member 2 on the guiding rail 11 of the mounting plate 1 as shown in FIGS. 3, 4 for an inclined skating.

Figure 1:
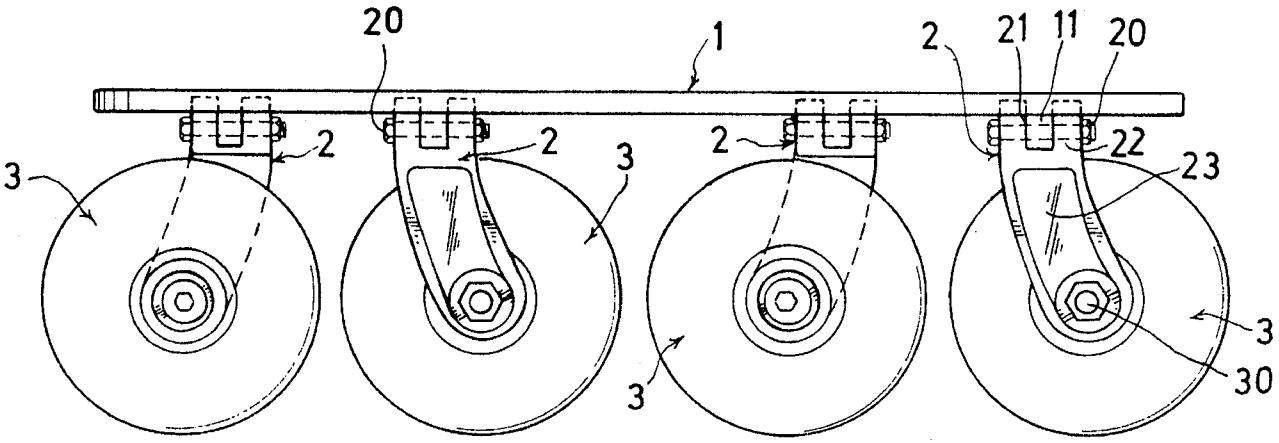
FIG. 1 is a front view of the present invention.
Figure 2:
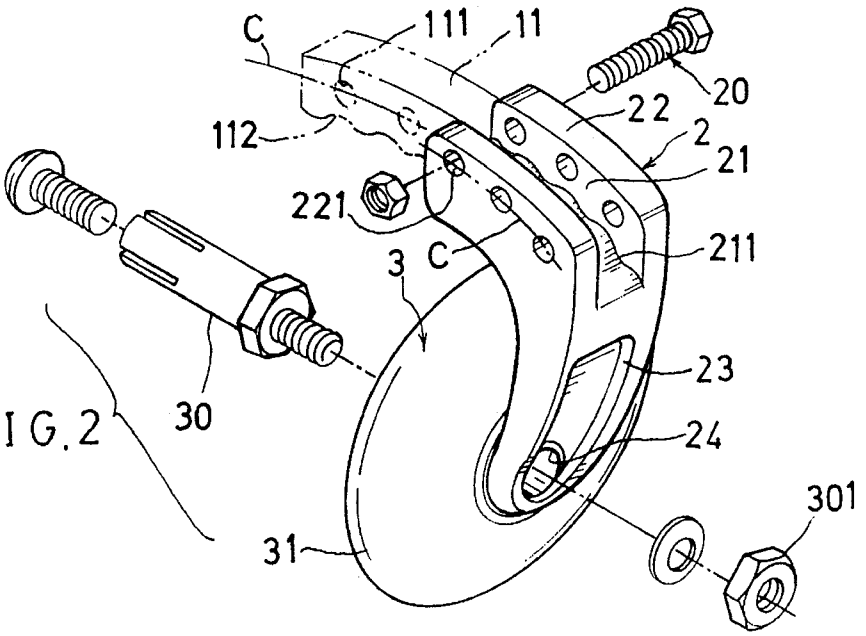
FIG. 2 is an illustration showing the parts for assembling each wheel and cantilever member of the present invention.

As shown in FIG. 1, the cantilever members 2 for rotatably mounting the front and rear wheels are preferably protruded forwardly and rearwardly to project the wheel perimeters beyond the front and rear edges of the mounting plate i for a stable skating.

The bolt holes 221 in the bracket 22 of the cantilever member 2 are arcuately disposed to projectively correspond the same curvature C of the guiding rail 11 of the mounting plate 1.

Figure 5:
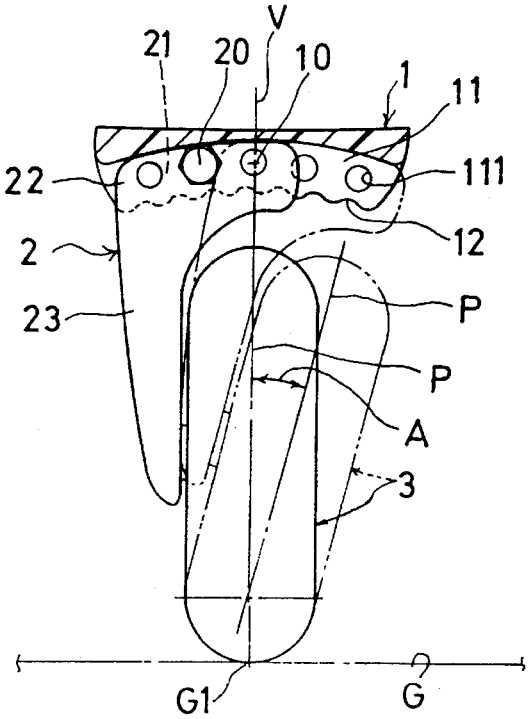
FIG. 5 shows a wheel of the present invention having a tendency for a rightward biasing movement.

By adjustably moving the cantilever member 2 on the rail 11 leftwardly as shown in FIG. 4, a leftward biasing angle A (such as 14 degrees) of the wheel 2 may be formed; while a rightward adjustment of the cantilever member 2 on the rail 11, a rightward biasing angle A may be obtained as shown in FIG. 5. The biasing angle A is defined between each longitudinal circular plane P of the wheel 3 and the vertical plane V along the longitudinal axis 10.

Figure 7:
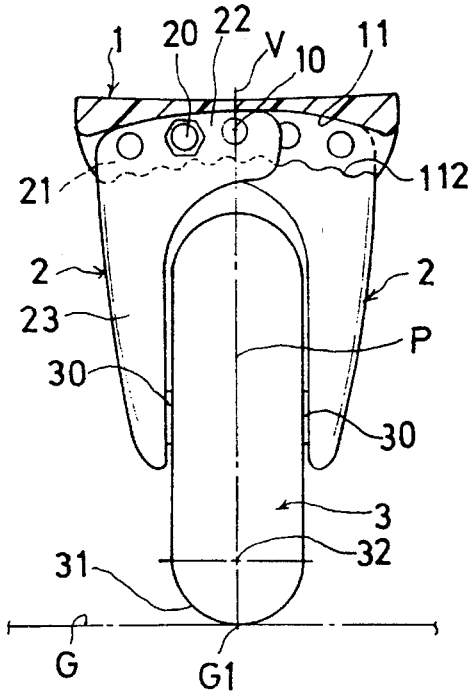
FIG. 7 is a side view of the present invention when viewed from 7—7 direction of FIG. 6
Figure 8:
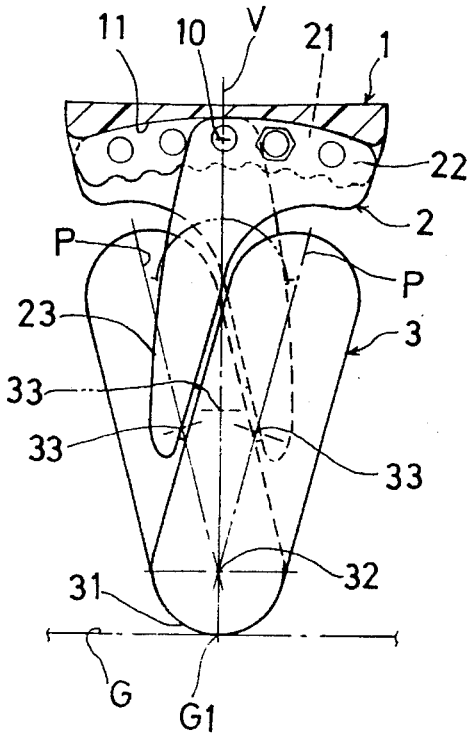

As shown in FIGS. 6–8, a skate with four wheels 3 is illustrated, in which the first and second wheels W1, W2 are respectively biased rightwardly and leftwardly as shown in FIG. 8 to lower the wheel centers 33 downwardly from a center 33 of the vertically erected wheel 3 as shown in dotted line of FIG. 8, indicating a lowering of gravity center of each wheel so as to increase the stability and traction of the skate wheels rolling on the skating surface G, thereby enhancing the maneuverability of the skate to be beneficial for figure skating. The two rear wheels W3, W4 are kept straight as shown in FIG. 7 to accelerate the wheel speed so as to facilitate a linear skating rapidly.

Therefore, the present invention provides a roller skate with each individual wheel adapted for an optional adjustment of its biasing angle from a vertical plane to meet the skater's personal habits and requirements, to thereby be superior to the conventional skate of angularly mounted wheels at fixed angles.

The present invention may be modified without departing from the scope and spirit of this invention.

I claim:

1. An in-line roller skate comprising:

a mounting plate having a footwear secured on an upper surface of the mounting plate, and having a plurality of arcuate guiding rails respectively juxtapositionally transversely formed on a bottom of the mounting plate, with a longitudinal axis defined along a center of the mounting plate and a vertical plane extending from the longitudinal axis to a skating surface under the mounting plate;

a plurality of cantilever members each slidably engageable with and movably adjustable on each said arcuate guiding rail on the mounting plate;

a plurality of wheels generally disposed under said mounting plate with an in-line relationship and each said wheel rotatably mounted on each said cantilever member; and means for connection of each said cantilever member on each said arcuate guiding rail to allow said cantilever to be angularly adjusted on said guiding rail based upon the vertical plane; whereby upon an angular adjustment of each said cantilever member on each said guiding rail, each said wheel as rotatably mounted on each cantilever member will be angularly biased from the vertical plane.

2. An in-line roller skate according to claim 1, wherein each said cantilever member includes: an arcuate bracket, an arcuate groove recessed in the arcuate bracket and slidably engageable with each said arcuate guiding rail formed on the mounting plate, and a cantilever portion protruding downwardly from the arcuate bracket for rotatably mounting each said wheel on a lower portion of the cantilever portion.

3. An in-line roller akte according to claim 2, wherein each said arcuate bracket is formed with a plurality of bolt holes equally spaced and arcuately formed on the bracket along an upper curvature of a tread center of each said wheel, and each said arcuate guiding rail formed with a plurality of bolt holes equally spaced and arcuately formed on the arcuate guiding rail along the upper curvature, whereby upon locking of a locking bolt through each said bolt hole formed in the bracket and each said bolt hole formed in the guiding rail, the bracket of the cantilever member will be stably locked on the guiding rail for biasing each said wheel from a vertical plane extending from a longitudinal axis defined along a center of the mounting plate.

4. An in-line roller skate according to claim 2, wherein said arcuate groove of the bracket is formed with a corrugated bottom in the arcuate groove, said corrugated bottom in the arcuate of said bracket movably engageable with a corrugated bottom portion formed on a bottom of the guiding rail for a stable engagement between the bracket of the centilever member and the guiding rail of the mounting plate.

5. An in-line roller skate according to claim 3, wherein each said wheel includes: an axle secured on an axle hole formed in a lower end portion of the cantilever member, a wheel center formed at a center of the wheel, a tread center formed at a curvature center of the circular tread of the wheel, with the wheel rolling on a skating surface, a longitudinal circular plane extending from the wheel center and being perpendicular to the axle, and the upper curvature disposed about the tread center having a radius defined between each center of the bolt hole formed in the guiding rail and said tread center, whereby upon an in-line arrangement of a plurality of said wheels along the vertical plane extending from the longitudinal axis of the mounting plate, and upon alignment of the wheel centers and the tread centers of the wheels to allow the longitudinal circular plane of each said wheel to be coplanar to the vertical plane, a linear skating of the wheels on the skating surface along a straight line is obtained; and upon a tilting of each said wheel from the vertical plane for adjusting a biasing angle of each said wheel from said vertical plane, an inclined skating is obtained.

* * * * *